United States Patent [19]

Friedman

[11] 4,188,446

[45] Feb. 12, 1980

[54] PAPER HAVING IMPROVED STRENGTH

[75] Inventor: Norman J. Friedman, Monmouth Junction, N.J.

[73] Assignee: Johnson & Johnson, New Brunswick, N.J.

[21] Appl. No.: 900,042

[22] Filed: Apr. 25, 1978

Related U.S. Application Data

[63] Continuation of Ser. No. 793,676, May 4, 1977, abandoned.

[51] Int. Cl.[2] ..... D04H 1/58

[52] U.S. Cl. ..... 428/288; 162/168 R; 260/17.4 CL; 260/29.6 MQ; 428/290; 428/920

[58] Field of Search ..... 428/288, 289, 290, 393, 428/394, 537, 920; 162/168 R; 260/17.4 CL, 29.6 MQ

[56] References Cited

U.S. PATENT DOCUMENTS

| | | | |
|---|---|---|---|
| 2,167,278 | 8/1939 | Leatherman | 260/17.4 CL |
| 2,176,053 | 10/1939 | Billing | 428/288 |
| 2,769,711 | 11/1956 | Wilson | 162/168 R |
| 3,081,197 | 3/1963 | Adelman | 428/288 |
| 3,126,297 | 3/1964 | Diamantopoulos | 428/288 |
| 3,157,562 | 11/1964 | Hine et al. | 428/288 |
| 3,294,580 | 12/1966 | Holb et al. | 428/288 |
| 3,526,540 | 9/1970 | Lindemann | 260/17.4 CL |
| 3,714,099 | 1/1973 | Biale | 260/29.6 MQ |

*Primary Examiner*—James J. Bell

*Attorney, Agent, or Firm*—Charles J. Metz

[57] ABSTRACT

There is disclosed a paper having improved strength. The paper contains a latex polymer binder and alkali metal alkylnaphthalene sulfonate.

6 Claims, No Drawings

PAPER HAVING IMPROVED STRENGTH

This is a continuation of application Ser. No. 793,676, filed May 4, 1977 abandoned.

The invention relates to a paper having improved strength, which paper is particularly useful in the production of disposable garments such as medical examination gowns.

BACKGROUND OF THE INVENTION

Paper products are being employed more frequently in the production of temporary or disposable garments, particularly for use in hospitals and for medical examinations. Their use is expanding because it is less expensive and more convenient to employ temporary or disposable garments, rather than to have to handle, store, and launder permanent garments.

Such temporary garments must meet a number of requirements. First, they must have sufficient strength to stand up to production, handling, and wearing. And second, for aesthetic reasons they must resemble cloth in hand and drape.

These two requirements are sometimes inconsistent with each other. For instance, one of the ways to increase strength in paper products is to incorporate therein a binder. As a general rule, strength is directly proportional to the amount of binder used. But there is a limit to the amount of binder that can be used because the binder will begin to bond to itself when its proportion in the paper is increased beyond a certain point. The result of such self-bonding would be an aesthetically undesirable stiffness or boardiness in the paper. Unfortunately, with many unreinforced paper products, at the highest proportion of binder that can be used because of aesthetic considerations, the strength is not adequate for use in disposable garments without employing 3 or more plys of paper, or the equivalent thereof by using extra heavy paper. Therefore, any means that can be found to increase the strength of such paper products, without making the paper stiff or boardy and without adding significantly to its cost, would be commercially desirable.

BROAD STATEMENT OF THE INVENTION

The invention provides a non-woven sheet material, suitable for use in disposable garments, said sheet material comprising:

(a) cellulosic paper-making fibers;

(b) a cross-linked ethylene/vinyl acetate latex polymer binder; and (c) in an amount sufficient to increase the strength of said sheet material as measured by at least one of tensile strength, tear strength, or Mullen burst, an alkali metal alkylnaphthalene sulfonate.

In preferred aspects, the non-woven sheet material of the invention contains one or more fillers, such as a pigment and/or one or more flame retardant materials.

THE PRIOR ART

Billing, in U.S. Pat. No. 2,176,053, describes textile fabrics which are sized with a sizing emulsion containing a thermoplastic resin and an emulsifying agent, including alkali metal alkylnaphthalene sulfonates.

Other United States Patents that disclose the use of various surfactants in bonded non-woven fabrics include the following: Nos. 2,737,179; 2,904,455; 3,014,263; 3,081,197; 3,126,297; 3,157,562; 3,294,580; 3,352,701; 3,607,359; and 3,952,128.

The class of alkali metal alkylnaphthalene sulfonates, wherein the alkali metal is ordinarily sodium, is disclosed generally for use in textiles as a dispersant, wetting agent, detergent, detergent coupler, and detergent builder, and for general use in pigment dispersing, not limited to its use for this application in textiles.

The specific sodium alkylnaphthalene sulfonate employed in the experiment reported below in Example 1 is recommended by its manufacturer as a color enhancer for pigment-based printing systems for textiles.

Surfactants are employed as dispersing aids in the polymerization of latexes, and as stabilizers for latexes.

DETAILED DESCRIPTION OF THE INVENTION

The paper products of the invention are produced by impregnating a web of paper with an aqueous mixture containing a cross-linkable ethylene/vinyl acetate copolymer latex and an alkali metal alkylnaphthalene sulfonate. The impregnated paper is then dried to remove the water and cross-link the latex polymer, to thereby produce the paper product of the invention.

The paper employed in the invention can be a conventional paper containing a wet-strength resin so that it will more readily withstand the impregnation step. Papers having basis weights (by the procedure of TAPPI T 140) of the order of from about 8 to about 20 pounds per 3000 square feet are especially useful in the invention, although heavier or lighter papers can be used if desired. Also, the web of paper can be composed of two or more plys of such paper. The paper should contain enough web strength resin so that it will maintain its integrity after absorbing a minimum of about two times its own weight of water. Such papers are well known in the art.

The cross-linkable ethylene/vinyl acetate copolymer employed as the latex polymer in the invention is a known material. Latex grade ethylene/vinyl acetate copolymers ordinarily have an ethylene to vinyl acetate ratio of from about 90:10 to about 10:90, and preferably from about 40:60 to about 60:40, by weight. The copolymer employed is also cross-linkable. The copolymer can be made cross-linkable by known means, such as by incorporating in the copolymer a reactive comonomer. A preferred reactive comonomer for such use is N,N-dimethylolacrylamide, which is usually used in relatively small amounts, e.g., up to about 10 weight percent, and preferably from about 1 to 4 weight percent, based on weight of the copolymer. The cross-linkable ethylene/vinyl acetate latex polymer employed will ordinarily be a soft material when cured, and will therefore usually have a glass transition temperature ("Tg") of not more than about 10° C.

The surfactant that is employed in the invention is an alkali metal alkylnaphthalene sulfonate. Ordinarily, the alkali metal is sodium. The naphthalene moiety of the surfactant molecule is substituted with one or more alkyl groups. The alkyl groups can individually contain from one up to eighteen or more carbon atoms. These materials constitute a well-known class of compositions. Specific alkali metal alkylnaphthalene sulfonates that are useful in the invention include sodium isopropylnaphthalene sulfonate, sodium butylnaphthalene sulfonate, sodium isobutylnaphthalene sulfonate, sodium pentylnaphthalene sulfonate, sodium octylnaphthalene sulfonate, and the like.

The paper product of the invention can also contain one or more other compositions. Such compositions are normally incorporated in the paper product by adding them to the aqueous mixture containing the latex and the alkali metal alkylnaphthalene sulfonate. Such other materials include flame retardants, fillers, pigments, dyes, softeners, and catalysts and/or cross-linking monomers for the latex polymer.

The flame retardants that can be employed, either singly or in mixtures thereof, include ammonium bromide, ammonium sulfamate, ammonium sulfate, various ammonium phosphates, such as mono- and diammonium phosphate, and others known to the art. Urea is often employed in combination with fire retardant materials such as ammonium bromide for the purpose of complexing or "fixing" the fire retardant in the paper.

Fillers and/or pigments can be used, singly or in combination, to opacify the paper. Specific illustrative examples include titanium dioxide, clay, diatomaceous earth, silica, phthalocyanine blue, phthalocyanine green, diarylide yellow, dianisidine orange, carbon black, pyrazolone red, and others known in the art.

Softeners that can be used include polyols such as ethylene glycol, diethylene glycol, glycerol, and sorbitol; lanolin; aromatic esters; polyethylene; and the like.

Catalysts that can be used to accelerate the cross-linking of the latex include the Lewis acids such as organic acids, mineral acids, and salts of strong acids with weak bases.

Compositions that can be used to accelerate and/or increase the degree of cross-linking of the cross-linkable latex include formaldehyde, glyoxal, melamine-formaldehyde resins, and phenol-formaldehyde resins.

Dyes such as fluorescent brighteners can also be used, if desired.

Surfactants (in addition to the alkali metal alkylnaphthalene sulfonate) can also be added to stabilize the aqueous mixture treating bath.

The above-enumerated materials are employed in conventional amounts. In Table I, below, the add-on amounts in which these materials are normally employed are displayed.

Table I

| Material | Parts, By Weight, Per 100 Parts Dry Paper |
|---|---|
| Latex | 10–60 |
| Filler/Pigment | 3–15 |
| Flame Retardant | 10–40 |
| Dye | 0–1 |
| Catalyst | 0–5 |
| Cross-linker | 0–5 |
| Softening Agent | 0–10 |
| Surfactant (Stabilizer) | 0–1 |

The alkali metal alkylnaphthalene sulfonate is used in an amount sufficient to increase the strength of the paper product, as measured by at least one of tensile strength (as determined by the procedure of TAPPI T-404), Mullen burst (ASTM D-774), or tear strength (TAPPI T-414). The precise amount required has not been found to be narrowly critical. In particular cases, routine experimentation will suffice to determine the optimum amount. It is most convenient to state the amount in terms of a proportion of the aqueous mixture treating bath. Thus, for treating baths having proportions of latex and total solids proportions similar to those discussed below in Example 1, the minimum effective amount of alkali metal alkylnaphthalene sulfonate is of the order of about 0.1 weight percent, based on total weight of bath. It would be rare that proportions in excess of about 1 to 1.5 weight percent of such baths would be used for the purposes of this invention.

The examples below illustrate the invention.

EXAMPLE 1

A web consisting of two plys of paper each having a basis weight of 13 pounds per 3000 square feet, and which contained sufficient wet strength resin (epichlorohydrin/polyamine condensate—5 to 8 pounds per ton of dry paper) so that the wet tensile strength is about 18 percent of the dry tensile strength, was impregnated with a treating bath of the composition shown below in Table II:

Table II

| | Percent Solids | Wet Weight (Grams) |
|---|---|---|
| Water | n/a | 2548.0 |
| Ammonium Bromide | 100 | 460.9 |
| Urea | 100 | 259.3 |
| Glycerine | 96 | 121.0 |
| Polyethylene Emulsion | 42 | 103.3 |
| Triton X-100 Nonionic Surfactant | 98 | 1.84 |
| Glyoxal | 40 | 4.58 |
| Titanium Dioxide | 67 | 254.4 |
| Diarylide Yellow-Pigment | 21 | 0.53 |
| Phthalocyanine Blue-Pigment | 39 | 1.98 |
| Ethylene/Vinyl Acetate Copolymer | 52 | 1244.9 |
| Mineral Oil Based Defoamer | 100 | 15.0 |
| Sodium Alkylnaphthalene Sulfonate | 25 | Varied |

To this aqueous mixture was added sufficient ammonium hydroxide to adjust the pH to the range of from 6.5 to 7.5. A total of 5,000 grams was prepared.

This master batch was divided into six 800-gram portions and various amounts of Calsol 150 (sodium alkylnaphthalene sulfonate, about 25% solids) were added to each of the six portions. The amounts added, and the proportions (of active surfactant) based upon weight of bath, are shown in Table III, below:

Table III

| Run | Total Weight of Calsol 150, Grams | Proportion, % |
|---|---|---|
| A | 0 | 0 |
| B | 4 | 0.125 |
| C | 8 | 0.25 |
| D | 12 | 0.375 |
| E | 16 | 0.5 |
| F | 32 | 1.0 |

The degree of impregnation of the paper was about 56–59 percent.

The six samples of paper were tested for tensile strength, tear strength, and Mullen burst. The results are tabulated below in Table IV, each value being the average of at least three tests:

Table IV

| Run Number | Basis Weight lbs/ream* | CD Dry Tensile, lbs/inch | CD Dry Stretch, Percent | MD Tear, Grams | Mullen Burst psi |
|---|---|---|---|---|---|
| A | 32.72 | 2.03 | 26.4 | 30 | 16.4 |
| B | 32.53 | 2.46 | 23.4 | 34 | 19.2 |
| C | 32.76 | 2.42 | 24.4 | 36 | 19.2 |
| D | 32.97 | 2.11 | 20.8 | 32 | 17.7 |
| E | 32.74 | 2.10 | 20.8 | 32 | 18.2 |
| F | 32.95 | 2.22 | 25.0 | 32 | 18.8 |

*3000 square foot ream.

The polyethylene emulsion in the above formulation was added for the purpose of making the flame retardant salt compatible with the pigments in the bath. The Triton X-100, a nonionic surfactant, was added to stabilize the bath, in particular, to help stabilize the blue pigment in the bath. The ethylene/vinyl acetate latex was a commercial product, "Airflex 120". It contained a small amount, between 1 and 4 weight percent, of polymerized N,N-dimethylolacrylamide. The Tg of Airflex 120 in the cured state is −20° C.

STANDARD TREATING PROCEDURE

The optimized method for producing the paper products described in Example 1 employs the treating apparatus depicted in FIG. 1 of Mayer, U.S. Pat. No. 3,720,573, modified as indicated below:

Two plys of the paper described in Example 1, each ply being 64 inches wide, are superimposed to form a two-ply web, which is passed through the nip of two polished steel counter-rotating rolls. The web is wound up at a speed of 180 yards per minute. The take-off speed is about 146 yards per minute. The average thickness of the two-ply web prior to treatment is about 5.2 mils (normal range is about 4 to 6 mils). The air pressure is adjusted so that the hydraulic pressure on the rolls is 40 psi. The bottom roll is immersed in a trough of treating mixture, such as that described in Example 1, containing 0.5 weight percent Calsol 150, based on total bath weight.

After passing through the nip, the web passes through spreading bars and into a two-zone, forced air tunnel oven 15 yards long. The temperature in the first (ingress) zone is 300° F., and in the second, 265° F.

After the tunnel oven, the web passes through another set of spreading bars, and then through five sets of steam-heated drying cans. Each set contains four cans, each can having a diameter of about one yard. The cans in the first set have steel surfaces, and are equipped with doctor blades to keep their surfaces clean. The remaining cans are Teflon coated. After passing through the five sets of drying cans, the web passes through a set of two air-cooled cooling cans. The temperatures in each of the sets of drying cans and the cooling cans, after equilibrium is reached in a typical run, are as follows:

Table V

| Drying Can Set No. | Temperature, °F. |
|---|---|
| 1 | 308–318 |
| 2 | 250–256 |
| 3 | 274–236 |
| 4 | 248–276 |
| 5 | 186 |
| Cooling Cans | 92 |

After passing through the cooling cans, the web passes through another set of spreading bars to a standard wind-up mechanism.

The final treated web is 62–63 inches wide, has a thickness of 4 to 5 mils, and contains 5 to 7 weight percent moisture. The degree of impregnation, using these conditions and the treating bath described in Example 1, is from about 56 to 59 percent, as determined by the following calculation:

$$\left[\left(\frac{\text{Weight per given area of treated web}}{\text{Weight of same area of untreated web}} \times \text{speed ratio}\right) - 1\right] \times 100$$

The speed ratio is the wind-up speed divided by the take-off or unwind speed.

Variations of this procedure are well within the skill of the art. For instance, at slower speeds, less heat would be needed in the drying cans.

ANALYSIS OF CALSOL 150

Various analyses were carried out on Calsol 150, and the results were consistent with the conclusion that it is a 25 weight percent aqueous solution of sodium isobutylnaphthalene sulfonate containing water of crystallization and very small amounts of polysubstituted naphthalenes as impurities, with the substituent groups being alkyl and/or sulfonate.

What is claimed is:

1. A non-woven sheet material suitable for use in disposable garments, said sheet material comprising:
   (a) cellulosic paper-making fibers;
   (b) a cross-linked ethylene/vinyl acetate latex polymer binder; and
   (c) in an amount sufficient to increase the strength of said sheet material, as measured by at least one of tensile strength, tear strength, or Mullen burst strength, an alkali metal monoalkylnaphthalene sulfonate, the alkyl group having from 3 to 8 carbon atoms.

2. The non-woven sheet material of claim 1 wherein said alkali metal is sodium.

3. The non-woven sheet material of claim 2 wherein said sheet material also contains at least one filler material.

4. The non-woven sheet material of claim 2 wherein said sheet material also contains at least one pigment.

5. The non-woven sheet material of claim 2 wherein said sheet material also contains at least one flame retardant material.

6. The non-woven sheet material of claim 2 wherein the alkali metal monoalkylnaphthalene sulfonate is sodium isobutylnaphthalene sulfonate.

* * * * *